United States Patent [19]

Tucker et al.

[11] 4,150,839

[45] Apr. 24, 1979

[54] TOY VEHICLE

[75] Inventors: James E. Tucker, Oak Park; Burton C. Meyer, Downers Grove, both of Ill.

[73] Assignee: Marvin Glass & Associates, Chicago, Ill.

[21] Appl. No.: 765,794

[22] Filed: Feb. 4, 1977

[51] Int. Cl.[2] ..... A63H 33/30

[52] U.S. Cl. ..... 280/771; 46/40; 214/915

[58] Field of Search ..... 280/87 R, 87 H, 87.01, 280/267, 771, 778; 180/77 H; 214/147 R, 147 G, DIG. 008; 46/40

[56] References Cited

U.S. PATENT DOCUMENTS

| | | | |
|---|---|---|---|
| 2,127,104 | 8/1938 | Bucklin | 280/87.01 |
| 2,455,692 | 12/1948 | McDunnah | 214/DIG. 8 |
| 2,523,093 | 9/1950 | Byrne | 46/40 X |
| 2,591,431 | 4/1952 | Henggeler | 214/147 G |
| 3,263,838 | 8/1966 | Herolf | 214/147 R X |
| 3,442,528 | 5/1969 | Rademacher | 280/87.01 X |
| 3,624,957 | 12/1971 | Good | 46/40 |

*Primary Examiner*—Richard A. Bertsch
*Assistant Examiner*—Michael Mar
*Attorney, Agent, or Firm*—Mason, Kolehmainen, Rathburn & Wyss

[57] ABSTRACT

A riding vehicle includes a body and a top portion defining a seat upon which the operator of the vehicle may sit. A plurality of wheels are rotatably secured to the body for movement over a suitable surface. A pair of the wheels are pivotally mounted on a steering column for controlling the direction of the vehicle. A grasping mechanism including a pair of operable jaw members is mounted by the steering column to permit grasping of objects such as, toys, balls, or the like.

16 Claims, 7 Drawing Figures

TOY VEHICLE

BACKGROUND OF THE INVENTION

A. Field of the Invention

The device of the present invention relates to a new and improved riding vehicle which includes a grasping mechanism for grasping various objects.

B. Description of the Prior Art

Recently, riding vehicles molded from plastic and including several wheels on which a child may ride have become popular. Prior art riding vehicles primarily have been intended for the sole purpose of riding by a child and for doing various stunts as riding over ramps, bridges and the like. These prior art vehicles primarily correspond to adult size vehicles such as automobiles and sport cars and generally have been capable of performing no functions other than providing a means of transportation and, thus, entertainment for the child.

SUMMARY OF THE INVENTION

An object of the present invention is to provide a new and improved riding vehicle including a manually operable grasping means capable of selectively grasping objects.

The present invention is directed to a new and improved riding vehicle including a molded body having a seat portion thereon upon which an operator, such as a child, may sit to propel the vehicle over a surface. A plurality of wheels are rotatably attached to the body for supporting the vehicle on the surface. A steering column is attached to the wheels to provide steering capability of the vehicle.

The vehicle also includes a manually operable grasping mechanism having two jaws that may be manually operated to grasp objects and move them from one point to another.

BRIEF DESCRIPTION OF THE DRAWINGS

The above and other objects, advantages and novel features of the present invention will become apparent from the following detailed description of a preferred embodiment of the invention illustrated in the accompanying drawings, wherein.

DETAILED DESCRIPTION OF THE PREFERRED EMBODIMENT

Figures 1, 2, 6, 7:
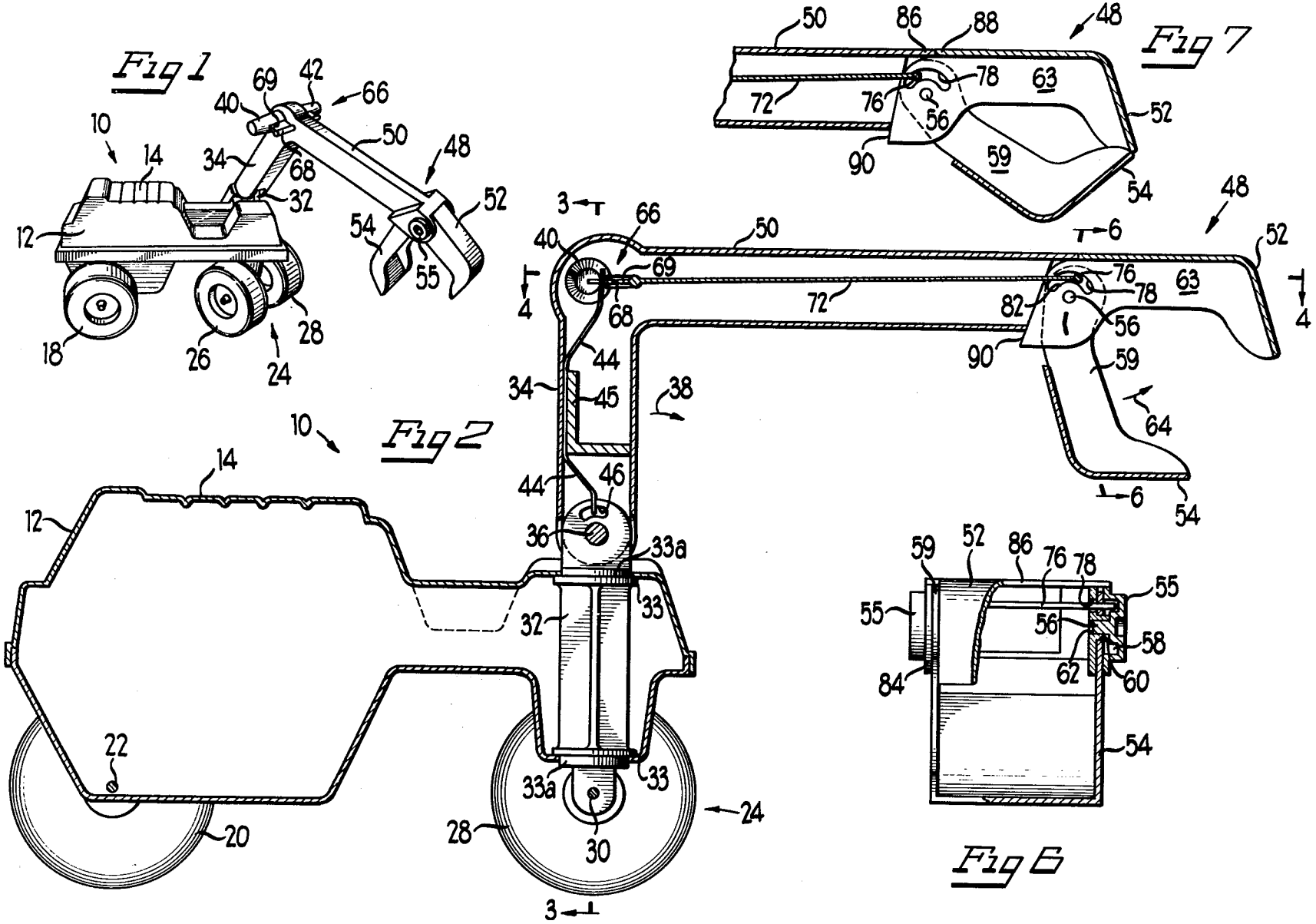
FIG. 1 is a perspective view of a preferred embodiment of a riding vehicle constructed in accordance with the present invention.
FIG. 2 is an enlarged, vertical sectional view of the riding vehicle.
FIG. 6 is a partially fragmented, vertical sectional view of the jaws of the grasping mechanism taken along line 6—6 of FIG. 2.
FIG. 7 is a fragmentary view, similar to FIG. 2, of the jaws of the grasping mechanism in the closed position.

Having reference now to the drawings, there is illustrated a riding vehicle generally designated by the reference numeral 10 constructed in accordance with the principles of the present invention. The riding vehicle is of the type to be ridden, for example, by a child and powered by the feet of the child as the child sits upon the vehicle 10. Accordingly, the vehicle 10 includes a body 12 having a seat 14 defined thereon. A pair of rear wheels, 18 and 20 are rotatably mounted at the back of the body 12 by a rod or axle 22.

Figure 3:
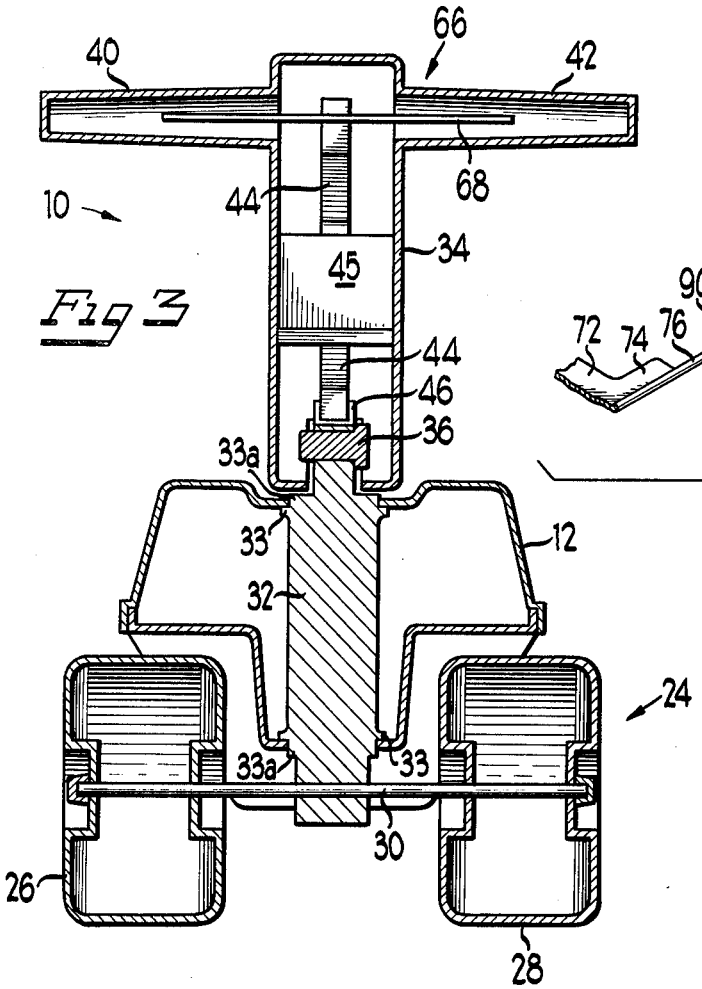
FIG. 3 is a vertical sectional view taken generally along line 3—3 in FIG. 2.

The vehicle 10 also includes a pair of front wheels generally designated by the numeral 24 that are pivotally mounted generally to the front end of the body 12. More specifically, the front set of wheels 24 includes a first 26 and second 28 wheel rotatably mounted by an axle 30 secured to a column 32 rotatably mounted in the front of the body 12 (FIGS. 2 and 3). The column 32 includes a pair of flanges 33 and journal bearings **33*a* which mount the column 32 within appropriately sized apertures in the body 12. The column 32 may be manually rotated relative to the body 12, as described below, thereby pivoting the set of wheels 24 to perform a steering function during the travel of the vehicle 12**.

More particularly the set of wheels 24 is attached to a steering column 34 through the column 32. The steering column 34 is secured thereto by a pin 36 so that angular rotation about a generally vertical axis of the column 34 imparts similar rotation to the column 32 to steer the vehicle. In addition, the steering column 32 through its coupling by the pin 36 may be pivoted forwardly in the direction of the arrow 38 (FIG. 2).

Figure 4:
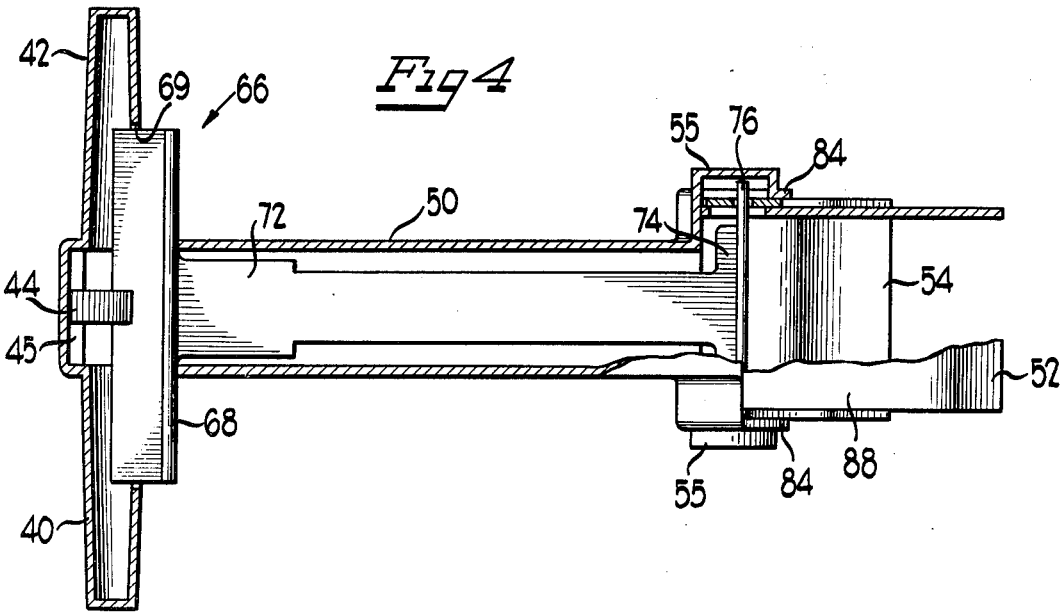
FIG. 4 is a horizontal sectional view of the grasping mechanism taken generally along line 4—4 in FIG. 2.

The column 34 includes a pair of handles 40 and 42 extending from opposite sides of the top of the steering column 34 as best seen in FIG. 4. The handles 40 and 42 may be grasped by the operator of the vehicle 10 and used to steer or rotate the steering column 34 thereby steering the vehicle 10. To maintain the steering column 34 in a vertical position relative to the vehicle 10 a leaf type spring 44 is secured within the steering column 34 by an angle bracket 45 and one end thereof is coupled within a slot 46 to the upper end of the column 32 at the other end.

In accordance with an important feature of the present invention, the vehicle 10 includes a grasping assembly or means generally designated by the reference numeral 48. The grasping assembly 48 may be operated by the child while seated on the vehicle 10 to grasp various objects for movement to different positions. The grasping mechanism 48 is coupled to the steering column 34 by an extension arm 50 forming a right angle therewith. The extension arm 50 is generally of hollow configuration and has pivotally mounted on the extreme end thereof a first or upper jaw 52 and a second or lower jaw 54. The jaws 52 and 54 are pivotally connected to both sides of the extension arm 50 by pins 56 which extend inwardly from a cap 55 through suitable annular recesses 58 in the extension arm 50. The pins 56 extend through apertures 60 on side flanges 59 of the lower jaw 54 and aperture 62 defined on side flanges of the upper jaw 52 to pivotally mount both jaws to the arm 50. Since this construction is identical on both sides of the mechanism 48, identical reference numerals are used on both sides and only one side will be described.

The lower jaw 54 is pivoted in the direction of the arrow 64 by an actuating device 66 defined on the handles 40 and 42. More specifically, the actuating device 66 includes a manually movable slide plate 68 mounted within the handles 40 and 42. The plate 68 extends through a transverse slot 69 defined in the handles 40 and 42 so that it may be gripped by the hands of the operator of the vehicle 10. The plate 68 is biased in a forward position by the upper end of spring 44 secured to the plate 68.

The plate 68 is also coupled to or formed integrally with an extension bar 72 which extends from the plate 68 to the jaws 52 and 54. A pin 76 is provided at the forward end 74 of the bar 72. This pin 76 extends through an arcuate slot 78 defined in the flange 63 of the upper jaw 52 and through an aperture 80 defined in the side flange 59 of the lower jaw 54.

Manual movement of the member 68 against the bias of the spring 44 causes the bar 72 to be drawn toward the handles 40 and 42 thus causing the pin 76 to move within the slot 78 relative to the flange 63. As this occurs, the pin 76 pulls the lower jaw 74 generally upwardly through the interaction of the pin 76 along the slot 78 and, particularly, along the cam surface 82 defined on one side of the slot 78. This action causes the lower jaw 54 to pivot relative to the upper jaw 52 as shown by arrow 64, until the lower jaw 54 engages the upper jaw 52.

Figure 5:
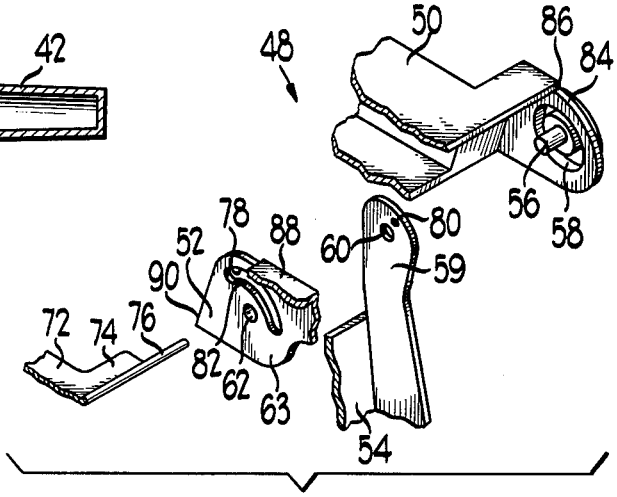
FIG. 5 is an exploded fragmentary view of the jaws of the grasping mechanism.

To provide a realistic appearance as the jaws 52 and 54 engage, the upper jaw 52 is partially pivoted relative to the extension arm 50. More specifically, the extension arm 50 includes a rounded flange portion 84 adjacent the upper jaw flange 59 and a transverse shoulder 86 defined by the end of the arm 50. In addition, the upper jaw 52 includes a flange 88 (FIG. 5) between the side flanges and an extending abutment member 90 along the lower end thereof. Due to the interaction of the pin 56 with the opening or aperture 60 in the upper jaw 52, the lower jaw 54 may pivot slightly relative to the arm 50 such that as the lower jaw 54 is pivoted by the actuating mechanism 66, it engages the upper jaw 52 at a position wherein the shoulder or the flange 88 is slightly spaced from the shoulder 86. Thus, upon engagement of the lower jaw 54 with the upper jaw 52, the upper jaw 52 pivots slightly relative to the arm 50 until the flange 88 engages the shoulder 86 (FIG. 7). This flange 88 and shoulder 86 provide a positive stop for the upper jaw of the grasping mechanism 48. Objects can be picked up from the floor or other surface by pivoting the grasping means 48 downwardly about the steering column pivot pin 36 for movement from place to place in conjunctive travel of the vehicle 10.

While the invention has been described with reference to details of the illustrated embodiment, it should be understood that such details are not intended to limit the scope of the invention defined in the following claims.

What is claimed and desired to be secured by Letters Patent of the United States is:

1. A toy vehicle, comprising:

a body;

a seat defined on said body;

a plurality of wheels rotatably secured to said body to support the vehicle for movement over a suitable supporting surface;

steering means rotatably mounted on said body and coupled to at least one of said wheels for steering said vehicle;

an extension arm mounted on said body for selective directional control;

manually actuatable grasping means mounted on said arm for grasping objects; and means mounting said grasping means for generally vertical movement relative to said supporting surface.

2. The vehicle claimed in claim 1 further including first biasing means for biasing said grasping means to a selected position relative to said body.

3. A riding vehicle comprising:

a vehicle body;

a seat for the operator of said vehicle defined on said body;

first and second sets of wheels secured to said body, said first set of wheels being pivotally secured to said vehicle for steering said vehicle;

a manually actuatable steering means secured to said first set of wheels for pivoting said wheels relative to said body to steer the vehicle during travel thereof over a suitable supporting surface;

an arm pivotally secured to said steering means and operatively associated therewith for movement relative to said vehicle and said steering means; and grasping means on the end of said arm including at least one selectively actuatable pivotally mounted jaw for frictionally engaging and capturing an object.

4. The vehicle of claim 3, wherein said arm includes a column portion universally mounted on said vehicle, and biasing means for biasing said arm to a selected position relative to said vehicle.

5. A toy vehicle, comprising:

a body portion having a seat defined thereon;

a plurality of wheels rotatably secured to said body to support the vehicle for movement over a suitable supporting surface;

steering means rotatably mounted on said body and connected to at least one of said wheels for steering the vehicle; and grasping means mounted on said steering means for grasping objects, said grasping means including a support frame pivotally mounted on the steering means, a pair of jaws, at least one of said jaws being pivotally mounted to said support frame, and manually operable means connected to said pivotal jaw for selective pivotal movement thereof to permit selective grasping of an object.

6. The vehicle claimed in claim 5 including second biasing means for biasing said jaws away from one another.

7. The vehicle of claim 5 wherein each of said jaws includes an open edge and said support frame is mounted on the body at a point to permit said open edges to contact said supporting surface.

8. A riding vehicle comprising:

a vehicle body;

a seat for the operator of said vehicle defined on said body;

first and second sets of wheels secured to said body, said first set of wheels being pivotally secured to said vehicle for steering said vehicle;

a manually actuatable steering means secured to said first set of wheels for pivoting said wheels relative to said body to steer the vehicle during travel thereof over a suitable supporting surface; and manually actuatable grasping means secured to said steering means and operatively associated therewith for grasping objects and moving said objects relative to said vehicle, said grasping means including an extension member secured to said steering means, first and second jaw members pivotally coupled to said extension member, and manual actuation means coupled to said first jaw for pivoting said first jaw member into engagement with said second jaw member.

9. The vehicle claimed in claim 8 said grasping means further including means for biasing said first jaw member out of engagement with said second jaw member and an elongated rod mechanically coupling said first jaw to said manual actuation means.

10. The vehicle claimed in claim 9 including lost motion means between said first and second jaw member for pivotal movement of both of said jaw members by a single connection to said manual actuation means.

11. The vehicle of claim 10 wherein said steering means includes a pair of handles and said manual actuation means includes a plate connected to said elongated rod, said plate being slideably mounted within the handles for movement with respect thereto.

12. A toy vehicle comprising:

a vehicle body;

a first set of wheels rotatably mounted on said body;

a second set of rotatable wheels;

pivotal steering means on said body for mounting said second set of wheels for relative movement to said body to steer said vehicle during travel thereof;

grasping means mounted on said steering means, said grasping means including an extension arm secured to said steering means, a first grasping member pivotally secured to said arm, and a second grasping member secured to said arm;

manually operable means on said steering means for pivoting said first grasping member relative to said arm; and means mounting said extension arm for vertical movement relative to said vehicle body.

13. The vehicle claimed in claim 12 further including first biasing means for biasing said grasping members to a selected position relative to one another.

14. The toy vehicle of claim 11 including means for biasing said first grasping member out of engagement with said second grasping member.

15. A toy vehicle, comprising:

a vehicle body;

a first set of wheels rotatably mounted on said body;

a second set of rotatable wheels pivotally secured to said body;

pivoting means secured to said body for pivoting said second set of wheels relative to said body to steer the vehicle during travel thereof;

grasping means mounted on said vehicle, said grasping means including an extension arm secured to said vehicle, a first grasping member pivotally secured to said arm, and a second grasping member secured to said arm;

manually operable means secured to said vehicle for pivoting said first grasping member relative to said arm, said manually operable means including an elongated rod connected to said first grasping member and a pair of actuators connected to said rod for permitting selective movement of the first grasping member toward the second grasping member; and means mounting said extension arm for side-to-side movement relative to said vehicle body.

16. The toy vehicle of claim 15 wherein said second grasping member is pivotally secured to said extension arm and said grasping means includes lost motion means between said first and second grasping members for pivotal movement of said grasping members by a single connection to said actuators.

* * * * *